US007566369B2

(12) United States Patent
Wittebrood

(10) Patent No.: US 7,566,369 B2
(45) Date of Patent: Jul. 28, 2009

(54) METHOD OF DE-COATING METALLIC COATED SCRAP PIECES

(75) Inventor: Adrianus Jacobus Wittebrood, Velserbroek (NL)

(73) Assignee: Aleris Aluminum Koblenz GmbH, Koblenz (DE)

( * ) Notice: Subject to any disclaimer, the term of this patent is extended or adjusted under 35 U.S.C. 154(b) by 548 days.

(21) Appl. No.: 10/489,098

(22) PCT Filed: Sep. 13, 2002

(86) PCT No.: PCT/EP02/10391

§ 371 (c)(1),
(2), (4) Date: Sep. 22, 2004

(87) PCT Pub. No.: WO03/024665

PCT Pub. Date: Mar. 27, 2003

(65) Prior Publication Data

US 2005/0022841 A1 Feb. 3, 2005

(30) Foreign Application Priority Data

Sep. 14, 2001 (EP) ..... 01203500
Mar. 15, 2002 (EP) ..... 02076020
Jul. 24, 2002 (EP) ..... 02078051

(51) Int. Cl.
*B08B 7/02* (2006.01)

(52) U.S. Cl. ..... 134/6; 134/7; 134/10; 134/25.1; 134/25.5; 134/30; 134/32; 134/34; 134/42

(58) Field of Classification Search ..... 134/6, 134/7, 10, 25.1, 25.5, 30, 32, 34, 42
See application file for complete search history.

(56) References Cited

U.S. PATENT DOCUMENTS 3,180,711 A * 4/1965 Aconsky ..... 422/145
3,260,574 A * 7/1966 Wirsing, Jr. et al. ..... 423/4
3,294,492 A * 12/1966 Bartlett et al. ..... 423/4
4,753,046 A 6/1988 Thonney
4,769,083 A 9/1988 Tiritilli
4,780,993 A 11/1988 DeSpain et al.

(Continued)

FOREIGN PATENT DOCUMENTS

EP 0190024 8/1986

(Continued)

*Primary Examiner*—Sharidan Carrillo
(74) *Attorney, Agent, or Firm*—Novak Druce + Quigg, LLP

(57) ABSTRACT

Method of de-coating metallic coated scrap pieces, the metallic coated scrap pieces comprising a metallic core layer and a metallic coating layer of which the liquidus temperature of the metallic coating layer is lower than the solidus temperature of the metallic core layer, such as brazing sheet scrap pieces, or from metallic coated scrap pieces of which the upper part of the melting range of the metallic core layer has an overlap with the lower part of the melting range of the metallic core layer. The metallic coating layer is at least partially removed from the metallic core layer of said scrap pieces by agitating the scrap pieces at an elevated temperature T above the solidus temperature of the metallic coating layer and below the liquidus temperature of the metallic core layer, together with abrading particles. The abrading particles are brought into fluidisation during the agitating of the metallic coated scrap pieces, thereby forming a fluidised bed.

18 Claims, 3 Drawing Sheets

U.S. PATENT DOCUMENTS

| | | | | | |
|---|---|---|---|---|---|
| 5,364,443 | A | * | 11/1994 | Tremblay et al. | 75/403 |
| 5,405,428 | A | * | 4/1995 | Dube et al. | 75/403 |
| 5,704,823 | A | * | 1/1998 | Wittebrood | 451/32 |
| 6,293,209 | B1 | * | 9/2001 | Nieminen et al. | 110/345 |
| 6,338,446 | B1 | | 1/2002 | Wittebrood | |
| 6,409,798 | B1 | * | 6/2002 | Nieminen et al. | 75/403 |
| 2005/0022841 | A1 | * | 2/2005 | Wittebrood | 134/6 |

FOREIGN PATENT DOCUMENTS

| | | | | |
|---|---|---|---|---|
| JP | 57041162 | | | 3/1982 |
| JP | 61501083 | | | 2/1984 |
| JP | 405059461 | A | * | 3/1993 |
| WO | WO9837246 | | * | 8/1998 |
| WO | WO9853108 | | * | 11/1998 |
| WO | 9932260 | | | 7/1999 |

* cited by examiner

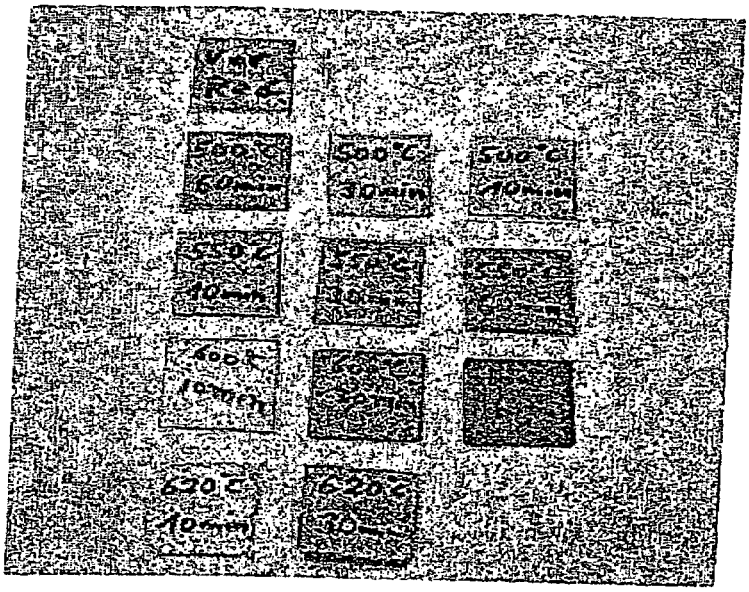
FIG. 2
FIG. 3
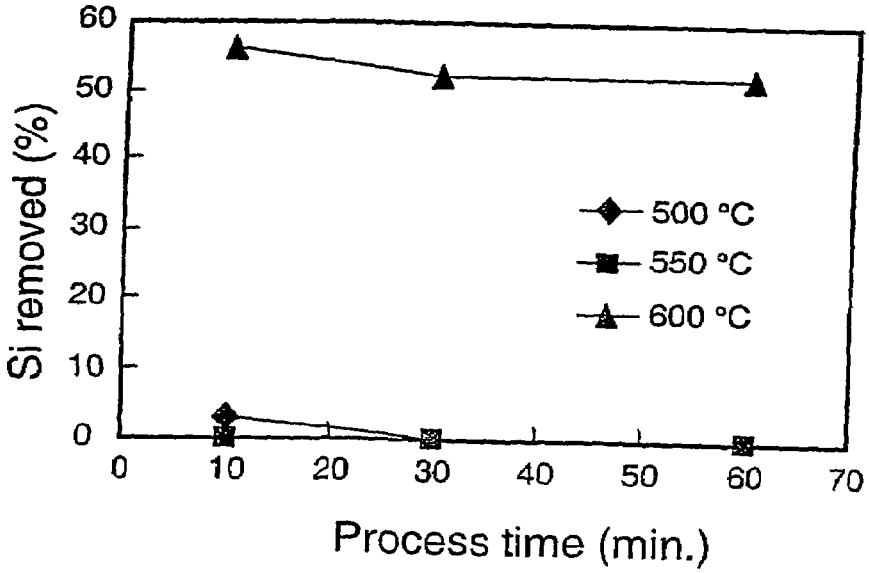

METHOD OF DE-COATING METALLIC COATED SCRAP PIECES

This application is a §371 National Stage Application of International Application No. PCT/EP02/10391, filed on 13 Sep. 2002, claiming the priority of European Patent Application No. 01203500.2 filed 14 Sep. 2001, European Patent Application No. 02076020.3 filed 15 Mar. 2002 and European Patent Application No. 02078051.6 filed 24 Jul. 2002.

FIELD OF THE INVENTION

The invention relates to a method of de-coating metallic coated scrap pieces, the metallic coated scrap pieces comprising a metallic core layer and a metallic coating layer whereby the liquidus temperature of the metallic coating layer is lower than the solidus temperature of the metallic core layer, such as brazing sheet scrap pieces, or from metallic coated scrap pieces of which the upper part of the melting range of the metallic coating layer has an overlap with the lower part of the melting range of the metallic core layer, wherein the metallic coating layer is at least partially removed from the metallic core layer of said scrap pieces by agitating the scrap pieces at an elevated temperature T above the solidus temperature of the metallic coating layer and below the liquidus temperature of the metallic core layer, together with abrading particles.

BACKGROUND OF THE INVENTION

The invention will be elucidated below for brazing sheet scrap, but the method can be used as well for other types of metallic coating layers on a metallic core.

During the production of brazing sheet a plate of an aluminium alloy having a relatively low Si content for the metallic core of the brazing sheet is on one or both sides clad by means of roll bonding with a plate of an aluminium alloy having a high Si content for the clad layer on the metallic core. This sandwich of metallic core plate and clad plate(s) is subsequently rolled so as to bind the clad layer(s) to the metallic core layer and to produce the brazing sheet product having a thickness of typically between 0.1 and 3 mm, for use in the production of for instance heat exchangers for automobiles.

During the production of the brazing sheet significant amounts of scrap are produced, for instance the heads and tails of the sandwich plates after each hot or cold rolling operation. Because the scrap contains both aluminium alloys with a high Si content and aluminium alloys with a low Si content, simple melting of the scrap would result in an aluminium alloy having a raised Si content as compared to the Si content of the metallic core, which is too high to be used for producing similar type metallic core plates, unless diluted with substantial amounts of alloys having a very low Si content.

Another source of brazing sheet scrap is formed by used products that are made out of brazing sheet, such as used heat exchangers.

Various methods are available to de-coat the clad alloy from the metallic core alloy in the scrap. One of these methods is described in international application no. WO 99/32260. According to this method, the metallic coating layer is separated from the metallic core, by rotationally tumbling or shaking the scrap metal pieces in a container together with abrading particles such as to agitate the scrap metal pieces together with the abrading particles and thereby causing multiple collisions, whereby the metallic coating layer is at least partially removed from the metallic core.

During the agitating, the container is held at a temperature whereby the temperature of the scrap metal pieces is higher than the solidus temperature of the metallic coating layer and lower than the liquidus temperature of the metallic core.

It is a disadvantage of the known method that thin gauge material, in particular sheet material with a thickness gauge of less than 2 mm, is difficult to process due to excessive wear on the thin gauge by the abrasive particles, resulting in a complete loss of material.

It is another drawback of the known method, that one or more alloy elements diffuse during processing at elevated temperature from the metallic coating layer to the metallic core, thereby further contaminating the metallic core material.

It is another disadvantage of the known method, that there is a risk that removed metallic coating material adheres to the abrading particles. This results in a reduction of abrasive properties.

SUMMARY OF THE INVENTION

It is an object of the invention to provide an efficient method of de-coating metallic coated scrap pieces, such as brazing sheet scrap, by removing a metallic coating layer from a metallic core layer of the metallic scrap pieces.

It is another object of the invention to provide such a method that is suitable to de-coat such metallic coated scrap pieces in a wide range of sheet thicknesses, including in particular, metallic scrap sheet with a thickness of less than 2 mm thickness.

It is still another object of the invention to provide such a method that is suitable for de-coating metallic coated scrap pieces with irregular morphology, such as scrapped and shredded heat exchangers.

It is still another object of the invention to provide a method of de-coating metallic coated scrap pieces such as brazing sheet scrap, with which large amounts of scrap can be processed.

It is yet another object of the invention to provide a method of de-coating such scrap that is economical on an industrial scale.

It is a further object of the invention to provide recycled metallic core and/or metallic coating alloys, which can easily be used for the production of new sheet material.

According to a first aspect of the invention, one or more of these objects are reached with a method of de-coating metallic coated scrap pieces, the metallic coated scrap pieces comprising a metallic core layer and a metallic coating layer whereby the liquidus temperature of the metallic coating layer is lower than the solidus temperature of the metallic core layer, such as brazing sheet scrap pieces, or from metallic coated scrap pieces of which the upper part of the melting range of the metallic coating layer has an overlap with the lower part of the melting range of the metallic core layer, wherein the metallic coating layer is at least partially removed from the metallic core layer of said scrap pieces by agitating the scrap pieces at an elevated temperature T above the solidus temperature of the metallic coating layer and below the liquidus temperature of the metallic core layer, together with abrading particles, wherein the abrading particles are brought into fluidisation during the agitating of the metallic coated scrap pieces, thereby forming a fluidised bed.

Fluidising converts a bed of solid particles into an expanded, suspended mass that has many properties of a fluid The abrading particles can be brought into fluidisation by feeding a homogeneous flow of a gas vertically through a quantity of particles. It has surprisingly been found that the abrading action of the particles brought in fluidisation is sufficiently high for removing the metallic coating layer, and at the same time it is sufficiently low to limit the wear on the metallic core. Because of the limited wear on the metallic core, thin scrap pieces can be de-coated.

Moreover, the fluid-like properties of the fluidised bed may result in a fairly uniform removal of the metallic coating layer, even in cases that the metallic scrap pieces have complicated shapes, such as folds or bends. Adhesion of abraded metal to the abrading particles may be reduced as a result of the continuous gas flow through the fluidised bed.

When the scrap pieces are at the temperature T within the specified temperature range, the metallic coating layer appears to be very weak and possibly partly molten and can be removed by the abrasive action of the fluidised particles. Wear on the metallic core layer is better avoided if the temperature T of the scrap pieces is kept lower than the solidus temperature of the metallic core layer.

In an embodiment of the invention, the fluidised bed is preheated to a fluidised bed temperature being at least the temperature T before introducing the metallic coated scrap pieces into the fluidised bed. The heat transfer from the fluidised bed to the metallic coated scrap pieces is very efficient. The de-coating process may therefore be relatively short, because of which the amount of diffusion of alloy elements from the metallic coating layer to the metallic core layer is limited.

Diffusion of alloying elements is even better avoided when the metallic scrap pieces are introduced into fluidised bed with the metallic scrap pieces at a temperature that is significantly below the temperature T, such as ambient room temperature.

The elevated temperature in the fluidised bed can be reached and/or maintained in various ways, one of which is using a heated gas flow to bring the particles into fluidisation.

Details of the method of the invention, such as process time, temperature, size and type of abrading particles, size of the scrap pieces, gas flow velocity, depend on the type of scrap pieces that are to be de-coated. These details can be optimised so that the desired result of removal of metallic coating layer on the core of the metallic scrap pieces is achieved.

In an embodiment, the scrap pieces are agitated by bringing them into fluidisation together with the abrading particles. Herewith a high efficiency of metallic coating layer removal, is achieved. A high degree of uniformity of the de-coating action is also achieved. In order to bring the scrap pieces into fluidisation along with the abrading particles, the shape and size of the scrap pieces should be tailored relative to the shape and density of the abrading particles, prior to inserting the scrap pieces in the fluidisation bed, for instance by using a mechanical treatment comprising shearing, cutting or chopping, preferably using a shredder.

In some cases it is particularly advantageous to keep the temperature T of the scrap pieces below the liquidus temperature of the metallic coating layer and below the solidus temperature of the metallic core layer. Herewith, adhesion of abraded and removed metallic coating layer material to the abrading particles may be reduced as a result of a lower amount of material will be in the liquid state.

Suitably the abrading particles are lumps or particles of metal, mineral, ceramic or similar hard material. Preferably, the abrading elements have irregular shapes such as lumps. But also some regular shapes can be used, such as pyramids or prisms. The abrading particles are, for example, selected from $Al_2O_3$, SiC, spinel, bauxite, ardenner split, steel slag, and ceramic rotofinish particles with a hardness such that erosion of the abrading particles is limited.

Although abrading particles of other materials may well be suitable, it is preferred to use one of those given above which are inert, in order to minimise adherence of removed metallic coating or cladding material to the abrading particles. Preferably the abrading particles used do not comprise to a significant extent any material that can react with the molten alloy ingredients of the metallic scrap pieces possibly present during the agitation, such as aluminium in case of aluminium brazing sheet scrap pieces.

The invention is particularly suitable for de-coating aluminium brazing sheet pieces, or products comprising aluminium brazing sheet. One of the properties of aluminium brazing sheet that is advantageously used in the method according to the invention is that the melting range of the metallic coating layer is purposely kept low compared to the melting range of the metallic core layer.

Typical suitable aluminium brazing sheet can have a core layer of the Aluminium Association AA 6xxx or the AA 3xxx aluminium alloys, in particular AA 6063, AA 6060, AA 3003, AA 3103, or AA 3005, and a clad layer of the AA 4xxx type aluminium alloy, such as AA 4343, AA 4047, AA 4004, or AA 4104. For these types, the Si content of the core is less than 0.6 wt. %, and the Si content of the clad layer is 6.8 to 13 wt. %.

In an embodiment of the method of the invention wherein the scrap pieces essentially consist of aluminium brazing sheet, the temperature T of the aluminium brazing sheet pieces is set at a value in the range of between 500° C. and 620° C. In this temperature range, the method is particularly suited for the removal of at least part of the metallic coating of aluminium brazing sheet, in which the metallic coating is an aluminium brazing alloy comprising Si as main alloying element in a range of 5 to 15 wt. %. The solidus temperature of the metallic core layer is of aluminium brazing sheet is typically higher than 620° C. Also, layers of aluminium alloys comprising Zn as main alloying element can be removed very effectively in this temperature range.

Preferably temperature T is set in the range between 500° C. and 580° C., in order to not exceed the liquidus temperature of the metallic coating layer of aluminium brazing sheet material. Herewith it is better ensured that abrasive action on the metallic core material is kept to a minimum, which is especially advantageous in the case of thin scrap pieces.

In an embodiment, the abrading particles have a density in the range of 3 to 7 g/cm$^3$ and a sieve fraction size in the range of 3 to 10 mm. Herewith a good balance is achieved between the abrasive impact of the particles and the ease of separating the removed metallic coating layer material and the remaining metallic core material from the abrading particles. The lower limit of the density range is just above the density of aluminium. In particular particles of essentially $Al_2O_3$, having a density of 4 g/cm$^3$, have proven useful abrading particles.

The scrap pieces may have a thickness in the range of 0.1 to 2 mm and an area of about 4 to 40 cm$^2$, depending on the density of the scrap pieces and the thickness.

BRIEF DESCRIPTION OF THE DRAWINGS

The invention will now be further explained with reference to the drawing, wherein

FIG. 2 shows a photographic image of de-coated metallic scrap pieces and a coated metallic scrap piece for reference;

FIG. 3 shows a graph setting out experimental results of Si-removal against process time.

DETAILED DESCRIPTION OF THE PREFERRED EMBODIMENTS

Details of typical fluid bed devices are well known and can be found in for instance Perry's, Chemical Engineering Handbook, six edition.

Figure 1:
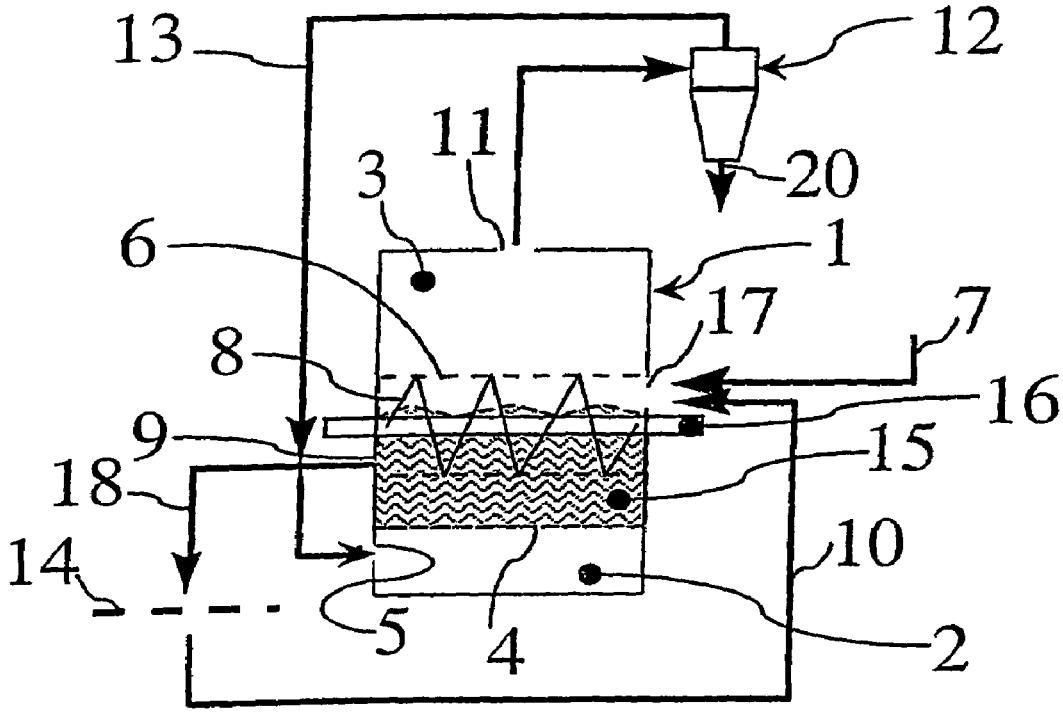
FIG. 1 shows a schematic cross sectional view of a device for performing an embodiment of the method according to the invention.

FIG. 1 schematically shows a chamber 1 which is provided with means for bringing abrading particles into fluidisation to form fluidisation bed 15. These means comprise a gas distribution chamber 2 and a fluidisation bed chamber 3, which are separated from each other by a distributor 4, which may be a finely perforated screen. The distribution chamber 2 is provided with a gas inlet 5.

The fluidisation bed chamber 3 is provided with a perforated drum 6 that is rotatable about axis 16. An inlet 17 for scrap material is present in the fluidisation chamber, from which inlet 17 scrap material 7 can be introduced into drum 6. The perforation of drum 6 is such that the abrading particles and the gas can go through the drum, while keeping the scrap pieces inside the drum. The drum 6 may also be provided with a screw profile 8 on its inside.

The drum leads to the side of the fluidisation chamber 3 facing opposite the inlet 17, where an outlet 9 is provided. This outlet is connected with sieving means 14 via a conduit, which conduit is schematically represented by arrow 18. The sieving means is connected also to inlet 17, as is schematically indicated by arrow 10.

The fluidisation chamber 3 is provided in its top with a gas flow outlet 11. FIG. 1 further shows separating means 12 which is connected via a conduit represented by arrow 19 to the gas flow outlet 11. The separating means 12 can be for instance filtering means, or cyclone means, or any other known industrial separating means. A return conduit, as represented by arrow 13, is provided for returning the gas to the distribution chamber 2 via the inlet 5. Heating means are present to reheat this return gas.

The invention works as follows. Gas is pumped into the distribution chamber 2. As a result of the gas flowing through the distributor 4, a homogeneous substantially vertical gas flow is achieved in the fluidised bed chamber 3. The abrading particles which are present in the fluidisation chamber 3 are brought into fluidisation as a result of the homogeneous vertical gas flow, forming the fluidisation bed 15.

Suitably the abrading particles are lumps or particles of metal, mineral, ceramic or similar hard material, preferably having irregular shapes such as-lumps. But also some regular shapes can be used, such as pyramids or prisms. The abrading particles are, for example, selected from $Al_2O_3$, SiC, spinel, bauxite, ardenner split, steel slag, and ceramic rotofinish particles with a hardness such that erosion of the abrading particles is limited.

Scrap pieces are introduced into the fluidised bed 15 via inlet 17. The drum 6 is rotated about its axis 16. This rotational motion can agitate the scrap pieces. Also, the scrap pieces may be of such a density and shape that they will be brought into fluidisation together with the abrading particles. A combination of both may also be employed. De-coating occurs in the fluidised bed 15.

When the drum is in rotation, the screw profile 8 causes a net mass distribution along the rotational axis 16 of the drum. The de-coated scrap pieces will thus eventually reach the outlet 9, from where it may be led to sieving means 14 for separating the scrap pieces from any abrading particles that have also been led out of the fluidisation chamber 3 via the outlet 9. The abrading particles may be recovered and returned to the fluidisation chamber via lead 10. The de-coated scrap pieces may be collected and reused elsewhere, for instance for the production of similar types of metallic coated products as before.

In cases where the metallic coating material does not disengage from the fluidised bed via the gas flow, it may be necessary to separate the removed metallic coating material from the abrading particles by sieving as well.

In some process types, however, metallic coating material that has been removed from the scrap pieces will disengage from the fluidised bed in the form of finely distributed particles such as dust, and will flow together with the gas and leave the fluidisation chamber 3 via the outlet 11. This metallic coating material can be filtered out of the gas in separating means 12, and collected as a separate recycled product 20. The gas may be recovered, re-heated, and led to the distribution chamber 2 via conduct 13.

The temperature of the fluidised bed 15 can be used to bring the metallic scrap pieces to their desired temperature in a temperature range according to the invention. For an aluminium cladding layer alloy containing 10 wt. % Si, the desired temperature is 575° C., as an example.

Due to the homogeneous removal of the metallic coating layer, the invention is particularly suitable for treating scrapped and shredded heat exchangers that were built using aluminium brazing sheet material.

The drawing serves as a schematic example of one possible way to perform the invention, and the invention is not limited hereto.

EXAMPLE 1

In one laboratory experiment, a mixture of approximately 10 kg of $Al_2O_3$ abrading particles having a particle size of between 3 and 5 mm and 160 g of platelets of 0.5 mm gauge brazing sheets measuring 25×25 $mm^2$ was brought into fluidisation at room temperature. The platelets and $Al_2O_3$ particles remained mixed in a homogeneous fluidisation bed and the no separation was observed to occur.

EXAMPLE 2

Another laboratory experiment was performed using a closed-loop experimental set up using cyclone means to separate particulates from the fluidising gas circulation. The experimental set up was not provided with the rotating drum nor with the scrap inlets an outlets as shown in FIG. 1.

In this laboratory experiment, three hundred platelets measuring 25×25 $mm^2$ and a scrapped radiator piece of the fin type and a scrapped radiator piece of the tube type, all made of 0.4 mm gauge brazing sheet having a core of an AA 3003 alloy (comprising 0.20 wt. % Si, substantially no Mg) and a 40-μm thin coating layer on each side of an AA 4004 alloy (comprising between 9.5 and 10 wt. % Si, and 1.5 wt. % Mg), were de-coated by bringing them into fluidisation together with 10 kg of bauxite particles having a particle size of between 3 and 5 mm. Various fluidised bed temperatures and process times were applied, in the range of 500° C. to 620° C. and in the range 10 min. to 60 min., respectively. For the purpose of this experiment, the fluidised bed temperature was taken to be the temperature of the fluidising gas.

FIG. 2 shows a photographic image of a platelet prior to subjecting it to the de-coating process (labeled "Vor Rec", and a platelet that has been subjected to the de-coating process each of the conditions of 10 min., 30 min. and 60 min. at 500° C., 10 min., 30 min. and 60 min. at 550° C., 10 min., 30 min. and 60 min. at 600° C., and 10 min. and 30 min. at 620° C.

As can be seen, the pieces which have the thickness gauge of 0.4 mm are able to withstand the method. It can be derived from the amount of rounding in the comers that. higher temperatures and/or longer process times result in some more abrasion of the platelets than is the case at lower temperatures and/or process times. Up to fluidised bed temperature of 600° C. the preservation of the retrieved platelets was acceptable. The platelet that was de-coated for 10 min. at a fluidised bed temperature of 620° C. shows relatively high abrasion. After running the process for 30 min., some platelets were found clustered together, presumably due to sticking effects related to melting of the coating layer, and the majority of the platelets was completely abraded and/or broken into pieces. Hence, it is preferred to run the process at a temperature of not higher than 620° C.

After subjecting the platelets to the processes indicated above, they were remelted and chemically analysed by spark emission spectroscopy. The analysis results were compared with the results of spark emission spectroscopy analysis of remelted reference platelet that was not subjected to any of the de-coating processes.

The Si removal, as expressed in a percentage, is determined by the following formula:

$$\text{Si removal}=(1-(Si_{after}-Si_{core})/(Si_{before}-Si_{core}))\times 100\%;$$

wherein $Si_{after}$ denotes the chemically analysed amount of Si from the remelt after the de-coating process, and $Si_{before}$ denotes the chemically analysed amount of Si from the remelt before the de-coating process, and $Si_{core}$ denotes the chemically analysed amount of Si from the core layer only.

FIG. 3 shows a graph of the percentage of Si that is found to be removed as compared to the reference platelet, as a function of process time for each of the fluidised bed temperatures 500, 550, and 600° C. As can be seen, over 50% of the Si has been removed using a temperature of 600° C. The Si removal is found to be effectuated in the first 10 minutes of the process. It is believed that Si diffuses from the metallic coating layer into the metallic core at the temperature of 600° C., and that for this reason the percentage of removable Si at 600° decreases with time.

On the other hand, it can be seen that for the alloys used in the present experiment, a fluidised bed temperature of more than 550° C. is preferred in order to obtain sufficiently high abrading action that enables de-coating in a reasonable time.

Figure 4:
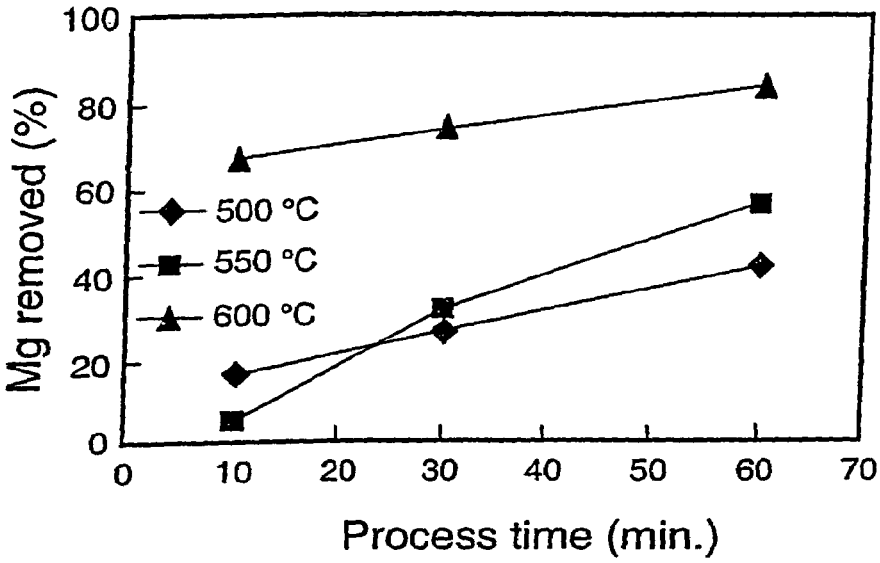
FIG. 4 shows a graph setting out experimental results of Mg-removal against process time

FIG. 4 shows a graph of the percentage of Mg that is found to be removed as compared to the reference platelet, as a function of process time for each of the fluidised bed temperatures 500, 550, and 600° C. As can be seen, for each temperature the Mg is removed quite significantly. The amount of Mg removed increases with both time and temperature. Within 10 minutes of de-coating at a fluidised bed temperature of 600° C., more than 60% of the Mg is found to be removed. It is believed that the efficient Mg removal is a consequence of a dynamic equilibrium involving Mg-rich surface oxides that are removed during the process on one hand and at the same time are supplemented with Mg diffusing out of the bulk on the other hand.

The cyclone content was analysed after having run the process at 600° C. Particles exceeding 0.5 mm were not analysed, since they were assumed to relate essentially to bauxite particles. The following Table I shows the percentage of Al in the particles smaller than 0.5 mm, as determined using wet chemical analysis.

TABLE 1

| Process time at 600° C. | % metallic Al |
|---|---|
| 10 min. | 37 |
| 30 min. | 24 |
| 60 min | 16 |

The results provide an indication that the removed coating layer is at least in part carried over to the cyclone. However, when the process time is increased, a lower fraction of Al is found. It seems possible that a relatively higher fraction of the removed aluminium sticks to the bauxite abrading particles. This is confirmed by the fact that the bauxite abrading particles turned grey.

Figure 5:
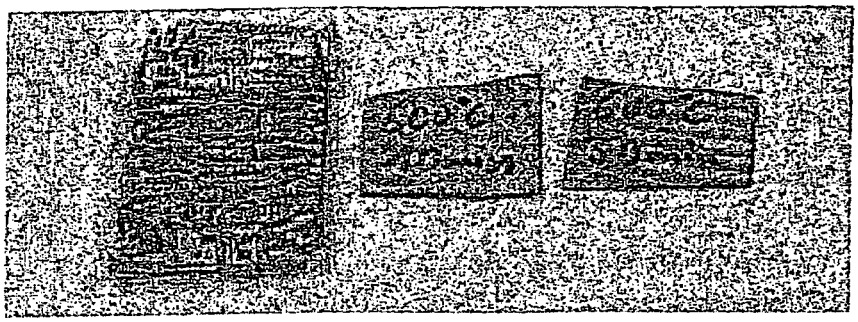
FIG. 5 shows a photographic image of de-coated radiator pieces of the fin type, and a coated radiator piece for reference.

FIG. 5 shows a photographic image of a scrapped radiator piece (left) prior to de-coating and of the de-coated pieces after de-coating at the fluidised bed temperature of 600° C. during 10 min. and 30 min, respectively. It is evident that during the de-coating process, the radiator parts lost their attached fins completely. The fins were removed from the fluidised bed by the hot air stream and were collected in the cyclone together with the abraded silicon-containing layer from the above described experiments.

EXAMPLE 3

The effect of the sieve fraction size of the abrading particles on the silicon removal (see Example 2 for the method of determination) was investigated by de-coating one batch of three hundred platelets similar to the platelets from Example 2 by bringing them into fluidisation together with 10 kg of bauxite particles having a sieve fraction size of between 3 and 5 mm, and one batch using the same amount of bauxite particles having a sieve fraction size of between 1 and 3 mm The temperature of the fluidised bed was 600° C. The following Table II shows the results:

TABLE II

| | Si removal after 5 or 12 minutes of de-coating of 0.4 mm platelets | |
|---|---|---|
| | Si removal | |
| | after 5 min. | after 12 min. |
| 3-5 mm bauxite | 40% | 47% |
| 1-3 mm bauxite | 60% | 65% |

The following Table III shows results of a similar test, wherein 200 platelets of 1.5 mm thickness having a core layer and 0.15 mm thick clad layers of similar aluminium alloys as above, were de-coated.

TABLE III

| | Si removal after 10, 20, and 30 minutes of de-coating of 1.5 mm platelets | | |
|---|---|---|---|
| | Si removal | | |
| | after 10 min. | after 20 min. | after 30 min. |
| 3-5 mm bauxite | 60% | 64% | 67% |
| 1-3 mm bauxite | 67% | 77% | 77% |

Referring to Tables II and III, clearly a better performance can be seen when using the smaller sized bauxite as abrading particles for platelets. The number of abrading particles present in the fluidised bed increases approximately with a third power of the sieve fraction size ratio for the same total mass of abrading particles. Where a higher number density of abrading particles is present in the fluidised bed, the number of collision events on a surface of a platelet increases, leading to a higher de-coating efficiency. Since the mass of each abrading particle reduces with the same ratio, the de-coating efficiency of each collision event reduces. These two counter acting effects result in an optimum sieve fraction size that results in the highest de-coating efficiency.

EXAMPLE 4

The effect of the sieve fraction size of the abrading particles on the silicon removal was investigated by de-coating 100 g of scrapped radiator pieces of the fin type, using 10 kg of bauxite particles having a sieve fraction size of 1-3 mm, and 10 kg of bauxite particles having a sieve fraction size of 3-5 mm.

The radiator was made of 0.4 mm gauge brazing sheet having a core of an AA 3003 alloy (comprising 0.20 wt. % Si, substantially no Mg) and a 40-μm thin coating layer on each side of an AA 4004 alloy (comprising between 9.5 and 10 wt. % Si, and 1.5 wt. % Mg).

The following Table IV shows the result after de-coating at 600° C. for 10 min.:

TABLE IV

| | Si removal after 10 minutes of de-coating of 0.4 mm scrapped radiator pieces |
|---|---|
| | Si removal after 5 min. |
| 3-5 mm bauxite | 57% |
| 1-3 mm bauxite | 39% |

In the case of scrapped radiator pieces, the sieve fraction size of between 3 and 5 mm shows a better result. Due to the higher mass of the individual particles with the higher sieve fraction size, the impact of individual collision events between an abrading particle and a scrapped radiator piece is higher resulting in a better removal of the attached fins.

EXAMPLE 5

The effect of the amount of abrading particles on the silicon removal was investigated by comparing de-coating one batch of three hundred platelets to another batch of six hundred platelets. The platelets were similar to the 0.4 mm thick platelets from Example 2. Table V shows the silicon removal (see Example 2 for the method of determination) after de-coating by bringing the platelets into fluidisation together with 10 kg of bauxite particles having a sieve fraction size of between 1 and 3 mm.

TABLE V

| | Si removal after 5, 12, and 20 minutes of de-coating of 0.4 mm platelets | | |
|---|---|---|---|
| | Si removal | | |
| | after 5 min. | after 12 min. | after 20 min. |
| 300 platelets | 60% | 65% | — |
| 600 platelets | 53% | 55% | 50% |

As can be seen, the de-coating efficiency is higher when a batch of 300 platelets is de-coated than when a batch of 600 platelets is de-coated.

This is presently thought to be related to the total surface area that is to be de-coated in one batch relative to the amount of abrading particles present in the fluidised bed. In the situation of Table V, the total surface area present in the batch of platelets amounts to approximately 0.375 $m^2$ for 300 platelets and 0.750 $m^2$ for 600 platelets.

Thus, at least for abrading particles having a material density in the range of 3 to 3.5 $g/cm^3$, such as bauxite, the amount of abrading particles in the fluidised bed per square meter of surface area to be de-coated is preferably chosen to be at least 10 $kg/m^2$, preferably at least 13 $kg/m^2$, more preferably at least 20 $kg/m^2$. These numbers may be generally valid when proper account is taken of the density of and sieve fraction size of the abrading particles.

The invention claimed is:

1. A method of de-coating metallic coated scrap pieces consisting essentially of aluminum brazing sheet pieces, the metallic coated scrap pieces comprising a metallic core layer and a metallic coating layer of which the liquidus temperature of the metallic coating layer is lower than the solidus temperature of the metallic core layer, comprising:

at least partially removing the metallic coating layer from the metallic core layer of said scrap pieces by agitating the scrap pieces at an elevated temperature T above the solidus temperature of the metallic coating layer and below the liquidus temperature of the metallic core layer, together with abrading particles, wherein the abrading particles are brought into fluidization during the agitating of the metallic coated scrap pieces, thereby forming a fluidized bed, wherein the scrap pieces are submerged in the fluidized bed, wherein the scrap pieces are agitated by bringing them into fluidization together with the abrading particles, wherein the abrading particles have a density in the range of 3 to 7 $g/cm^3$ and a sieve fraction size in the range of 3 to 10 mm, and wherein the scrap pieces have a thickness in the range of 0.1 to 2 mm and an area of about 4 to 40 $cm^2$;

wherein the fluidized bed is within a fluidization bed chamber provided with a perforated drum, the perforated drum having opposed first and second ends and having sidewalls, the first end having a drum inlet, the second end having a drum outlet, the sidewalls having perforations, wherein fluidizing gas passes upwardly through the fluidized bed, wherein the abrading particles and the fluidizing gas pass into and out of the drum through the drum perforations, wherein the scrap pieces pass through the drum inlet into the perforated drum while the perforated drum is rotating about a perforated drum longitudinal axis, the scrap pieces are abraded in the drum by the abrading particles, and the scrap pieces discharge from the drum through the drum outlet and do not discharge through the drum perforations.

2. The method according to claim 1, wherein the fluidized bed is preheated to a fluidized bed temperature being at least the temperature T before introducing the metallic coated scrap pieces into the fluidized bed.

3. The method according to claim 1, wherein the temperature T of the scrap pieces is kept below the liquidus temperature of the metallic coating layer and below the solidus temperature of the metallic core layer.

4. The method according to claim 1, wherein the temperature T of the aluminium brazing sheet pieces is set at a value in the range of between 500° C. and 620° C.

5. The method according to claim 1, wherein the temperature T of the aluminium brazing sheet pieces is set at a value in the range of between 500° C. and 580° C.

6. The method according to claim 1, wherein the abrading particles are fluidized with air.

7. The method according to claim 1, wherein the scrap pieces have a thickness in the range of 0.4 mm to less than 2 mm.

8. The method according to claim 1, wherein the scrap pieces within the drum contact a screw profile within the drum.

9. The method according to claim 1, wherein the scrap pieces discharged from the drum pass through a conduit to sieving means and pass through the sieving means for separating scrap pieces from abrading particles, and recycles the abrading particles from the sieving means to the drum inlet.

10. The method according to claim 1, wherein the fluidizing gas and entrained particles of metallic coating separated from the scrap pieces pass upwardly out of the fluidized bed and then into a separating means for separating the entrained particles from the fluidizing gas, then the separated fluidizing gas is optionally returned to a distribution chamber below the fluidized bed.

11. The method according to claim 2, wherein the temperature T of the scrap pieces is kept below the liquidus temperature of the metallic coating layer and below the solidus temperature of the metallic core layer.

12. A method of de-coating metallic coated scrap pieces consisting essentially of aluminum brazing sheet pieces, the metallic coated scrap pieces comprising a metallic core layer and a metallic coating layer, comprising:

at least partially removing the metallic coating layer from the metallic core layer of said scrap pieces by agitating the scrap pieces at an elevated temperature T above the solidus temperature of the metallic coating layer and below the liquidus temperature of the metallic core layer, together with abrading particles, wherein the abrading particles are brought into fluidization during the agitating of the metallic coated scrap pieces, thereby forming a fluidized bed, wherein the abrading particles have a density in the range of 3 to 7 g/cm$^3$ and a sieve fraction size in the range of 3 to 10 mm, and wherein the scrap pieces have a thickness in the range of 0.1 to 2 mm and an area of about 4 to 40 cm$^2$;

wherein the fluidized bed is within a fluidization bed chamber provided with a perforated drum, the perforated drum having opposed first and second ends and having sidewalls, the first end having a drum inlet, the second end having a drum outlet, the sidewalls having perforations, wherein fluidizing gas passes upwardly through the fluidized bed, wherein the abrading particles and the fluidizing gas pass into and out of the drum through the drum perforations, wherein the scrap pieces pass through the drum inlet into the perforated drum while the perforated drum is rotating about a perforated drum longitudinal axis, the scrap pieces are abraded in the drum by the abrading particles, and the scrap pieces discharge from the drum through the drum outlet and do not discharge through the drum perforations.

13. The method according to claim 12, wherein the abrading particles have a density in the range of 3 to 3.5 g/cm$^3$ and a sieve fraction size in the range of 1 to 3 mm and the amount of abrading particles in the fluidized bed per square meter of surface area to be de-coated is at least 20 kg/m.

14. The method according to claim 12, wherein the abrading particles have a density in the range of 3 to 7 g/cm$^3$ and a sieve fraction size in the range of 0.5 to 4 mm.

15. The method according to claim 12, wherein the liquidus temperature of the metallic coating layer is lower than the solidus temperature of the metallic core layer.

16. The method according to claim 12, wherein the scrap pieces within the drum contact a screw profile within the drum.

17. The method according to claim 12, wherein the scrap pieces discharged from the drum pass through a conduit to sieving means and pass through the sieving means for separating scrap pieces from abrading particles, and recycles the abrading particles from the sieving means to the drum inlet.

18. The method according to claim 12, wherein the fluidizing gas and entrained particles of metallic coating separated from the scrap pieces pass upwardly out of the fluidized bed and then into a separating means for separating the entrained particles from the fluidizing gas, then the separated fluidizing gas is optionally returned to a distribution chamber below the fluidized bed.

* * * * *